US010092122B2

(12) United States Patent
Bing et al.

(10) Patent No.: US 10,092,122 B2
(45) Date of Patent: Oct. 9, 2018

(54) SLIP RESISTANT MAT WITH STABILIZING PROJECTIONS

(71) Applicant: Cintas Corporation, Cincinnati, OH (US)

(72) Inventors: Richard R. Bing, West Chester, OH (US); Patrick J. Chilenski, Cincinnati, OH (US); Jeffery L. Cofer, Conyers, GA (US); Ian S. Malpass, Palm Beach Gardens, FL (US); David Mesko, Wyoming, OH (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 0 days.

(21) Appl. No.: 15/241,561

(22) Filed: Aug. 19, 2016

(65) Prior Publication Data

US 2017/0055749 A1 Mar. 2, 2017

Related U.S. Application Data

(60) Provisional application No. 62/209,379, filed on Aug. 25, 2015.

(51) Int. Cl.
*B32B 3/00* (2006.01)
*A47G 27/02* (2006.01)

(52) U.S. Cl.
CPC ... *A47G 27/0212* (2013.01); *Y10T 428/24182* (2015.01)

(58) Field of Classification Search
CPC ..... Y10T 428/24182; A47L 23/26; A47L 23/266; A47K 3/002; A47G 27/031; A63B 21/4037
See application file for complete search history.

(56) References Cited

U.S. PATENT DOCUMENTS

| | | | | |
|---|---|---|---|---|
| 2,081,992 | A | 6/1937 | Gavlak | |
| 3,434,715 | A * | 3/1969 | Brantingham | A47G 27/0231 482/79 |
| 4,361,614 | A | 11/1982 | Moffitt, Jr. | |
| 4,509,510 | A * | 4/1985 | Hook | A61H 7/001 156/292 |
| 6,014,779 | A | 1/2000 | Lindholm | |
| 6,042,915 | A | 3/2000 | Kessler | |
| 6,068,908 | A | 5/2000 | Kessler et al. | |
| 6,589,631 | B1 * | 7/2003 | Suzuki | A47G 27/0231 15/215 |
| 6,726,190 | B2 | 4/2004 | Malpass et al. | |
| 6,946,183 | B2 | 9/2005 | Malpass et al. | |
| 9,321,242 | B1 * | 4/2016 | Siegel | B32B 3/30 |

* cited by examiner

*Primary Examiner* — Alexander S Thomas
(74) *Attorney, Agent, or Firm* — Wood Herron & Evans LLP

(57) ABSTRACT

A slip resistant floor mat includes a number of upstanding projections in the form of blades or teeth arranged on an upper surface thereof. The blades or teeth deflect under a load and dissipate the force of the load so that the tendency of the mat to slip on the underlying floor is reduced.

17 Claims, 3 Drawing Sheets

SLIP RESISTANT MAT WITH STABILIZING PROJECTIONS

This claims the benefit of U.S. Provisional Patent Application Ser. No. 62/209,379, filed Aug. 25, 2015 and hereby incorporated by reference in its entirety.

BACKGROUND OF THE INVENTION

This invention relates generally to floor mats and, more particularly, to a floor mat which resists slipping relative to the underlying floor when a force is applied to the top of the mat such as a foot step, rolling cart or similar interaction.

In the past, floor mats were often made with either a smooth back, primarily for solid or non carpeted floors, or with a variety of "grippers" or "cleats" arranged on a bottom surface of the mat to reduce movement of the mat on carpeted floors. However, both of these approaches resulted in floor mats that were not skid resistant on smooth floors, especially those floors with high traffic areas or loads being moved over them. The movement of the mat in the gripper/cleat mat design results from the force of foot, vehicle and other traffic on the mat which causes a deformation around the compressed area of the mat and then upon removal of such force the mat returns to a different position on the floor. For the smooth back mats, movement of the mat results from similar forces and the lack of any device or feature intended to secure the mat in place.

A number of approaches have been attempted to reduce the movement or slippage of mats relative to an underlying floor. One known approach to the problem is to fasten the mat to the intended floor surface by various devices, such as that suggested by Kessler in U.S. Pat. No. 6,068,908. The invention of that patent utilizes a system by which a mat is fastened to the surface using a clip system. While this approach is well-developed, it results in floor mats that are difficult or impossible to move from place to place and the structures required to attach the mat add cost to the mat and difficulty during the installation. Also, attached mats are typically more rigid.

Another approach involves the use of a frame into which the mat is placed, such as the frames used by Moffitt, Jr. in U.S. Pat. No. 4,361,614 and Kessler in U.S. Pat. No. 6,042,915. The frame can be located upon the flooring surface or inlaid to be flush with the flooring surface. In either circumstance, unless the frame is fastened as mentioned above or embedded in the surface, the frame still has a tendency to shift relative to the floor surface. If the frame is fastened or embedded, the other problems mentioned above still remain including particularly the ability to relocate the mat to a different location on the floor.

Another approach involves the use of suction cups, such as those commonly found on shower and bath mats, examples of which can be found by Lindholm in U.S. Pat. No. 6,014,779 in which the corners of a rectangular mat are held by four suction cups and by Gavlak in U.S. Pat. No. 2,081,992 in which a plurality of suctions cups holds the bathtub mat to the surface. While this approach often provides acceptable slip-resistance for light shower and bath mat applications, traditional suctions cups are not sufficient to provide sufficient anti-skidding forces to prevent slipping and movement in high traffic and high load areas particularly on smooth floors such as tile, marble or wood floors. Traditional suction cups also result in a wavy mat surface which is more difficult for individuals and loads to traverse.

As mentioned, existing approaches to reducing movement of mats include significant limitations. Further, the known approaches require additional space, components, installation effort and cost, often at the expense of functionality. As a result, significant improvement can still be made relative to reducing the movement of mats.

SUMMARY OF THE INVENTION

These and other shortcomings with prior mats have been addressed with this invention which in various embodiments utilizes projections formed on the top surface of the mat to reduce movement of the mat on the underlying surface, typically floors. This invention utilizes a number of projections to reduce the movement of the mat. The projections are formed on the top surface of the mat. Upon an initial force being applied to the mat, such as a footstep or vehicular traffic, the projections are deformed or deflected, thereby providing a force that acts to adhere the mat to the surface and assist in retaining the mat in its original position. As the force over a particular area of the mat increases, if the force is sufficiently large, the projections will deform or bend to dissipate the force of the traffic on the mat so that movement of the mat relative to the floor is reduced, minimized or eliminated. The projections accept and dissipate the forces that act to oppose the lateral motion of the mat on the floor that would otherwise result from the applied forces.

The size, shape and specifications of the projections can be varied and the projections can be positioned in a variety of arrangements on the mat. The projections can be any shape that is formed on the top surface of the mat, provided that they bend or deflect upon contact. In one embodiment, the projections are spaced blades or teeth with a rectangular cross-section and are arranged in rows with the projections in each row being of the same height and the projections in alternating rows are of different heights. In various embodiments, the projections are positioned in evenly spaced parallel rows resulting in an evenly spaced grid arrangement, although they can be spaced in varied combinations. In one embodiment, the pattern does not extend to the edge of the mat in order to prevent tearing and permit the edge of the mat to include a ramp.

In another embodiment, the projections are different sizes and shapes. The existence of multiple sizes and shapes of projections permits improved performance on a variety of floor surfaces since larger projections perform better on some surfaces and smaller projections perform better on others.

While the mat can be made from different materials, it is typically rubber. The rubber can be a soft, low durometer rubber compound, such as LD-35, by being plied to a T6 aluminum mold to form the projections. Also, if desired, additives can be introduced to the mat to make it anti-bacterial.

One advantage of the invention is that the mat resists slipping to a much greater extent than existing mat designs. Another advantage of the invention is that the edges of the mat are more stable and therefore it is less of a tripping hazard or obstacle than traditional mats in which the edge of the mat easily rolls up onto or under the mat. Another advantage is that the mat of this invention provides the enhanced slip-resistance without adding any weight or installation complexity. Another advantage is that the invention does not require any permanent fastening means and is therefore easy to move to different locations. Another advantage is that the projections provide some additional cushioning for pedestrian and vehicular traffic. Another advantage is that the cushioning of the projections yields an anti-fatigue effect, thereby resulting in reduced wear and tear and routine maintenance and increased user comfort, especially for locally stationed employees spending long period of time on the mat. Another advantage of the invention is that the slip-resistance is effective on a wide variety of surfaces because of the use variable spaced, sized and shaped projections.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
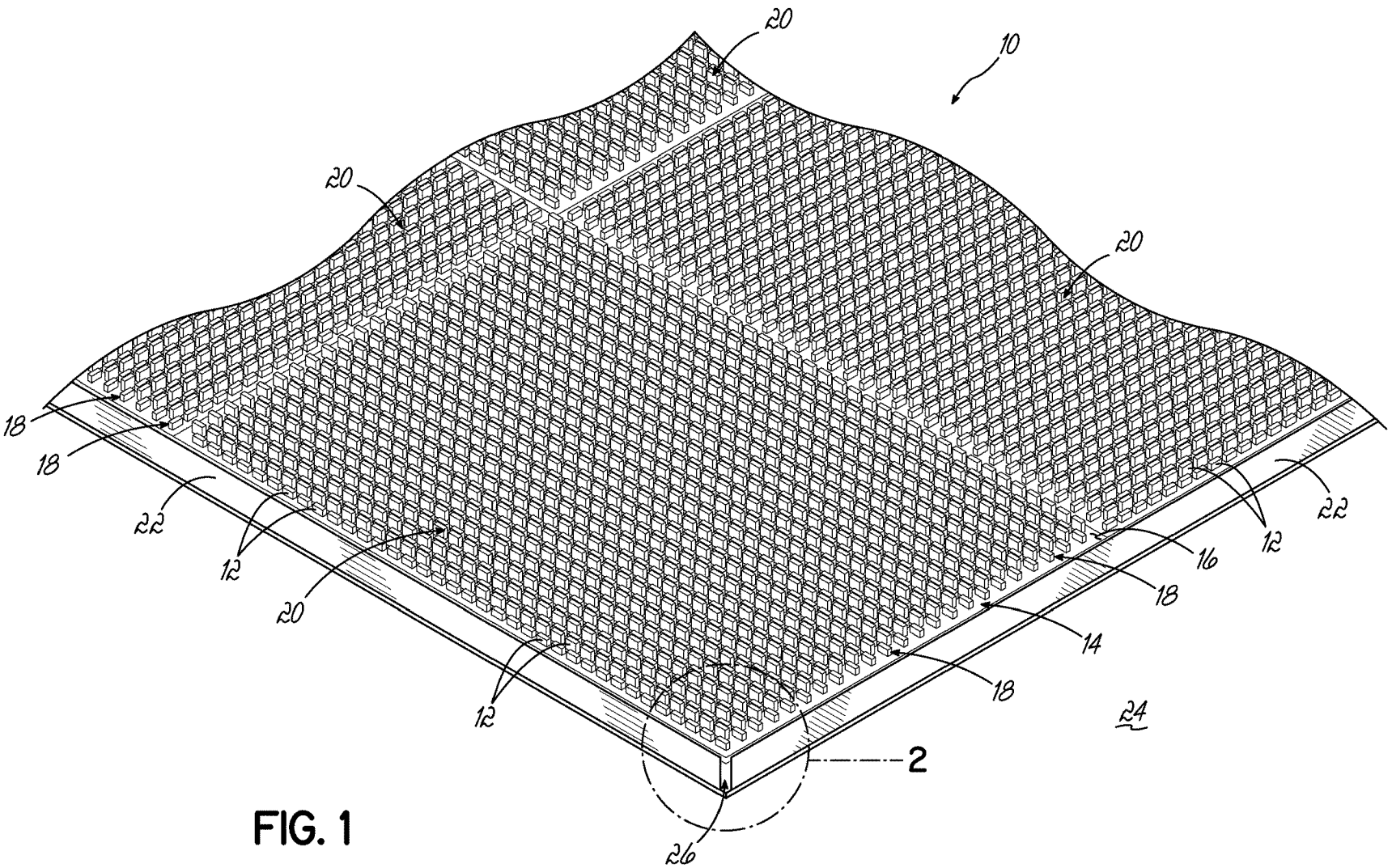
FIG. 1 is a perspective view of one embodiment of a slip resistant mat according this invention.

Referring to FIG. 1, one embodiment of a slip-resistant mat 10 with stabilizing projections 12 according to this invention is shown. The mat 10 includes a mat body 14 having an upper surface 16. A number of projections 12 extend upwardly from the upper surface 16 of the mat body 14. The projections 12, according to various embodiments of this invention, are arranged in multiple-spaced rows 18, and are similarly oriented in one embodiment of this invention. In various embodiments of this invention, the projections 12 may be arranged in an orderly consistent uniform arrangement, at least in portions of the mat 10. In alternative embodiments of this invention, the projections 12 are arranged in sections, or quadrants 20, with the orientation of the projections 12 and the rows 18 being generally perpendicular to the orientation of the projections 12 and rows 18 in adjacent quadrants 20 or sections of the mat 10. This arrangement is readily seen in FIG. 1.

Figure 2:
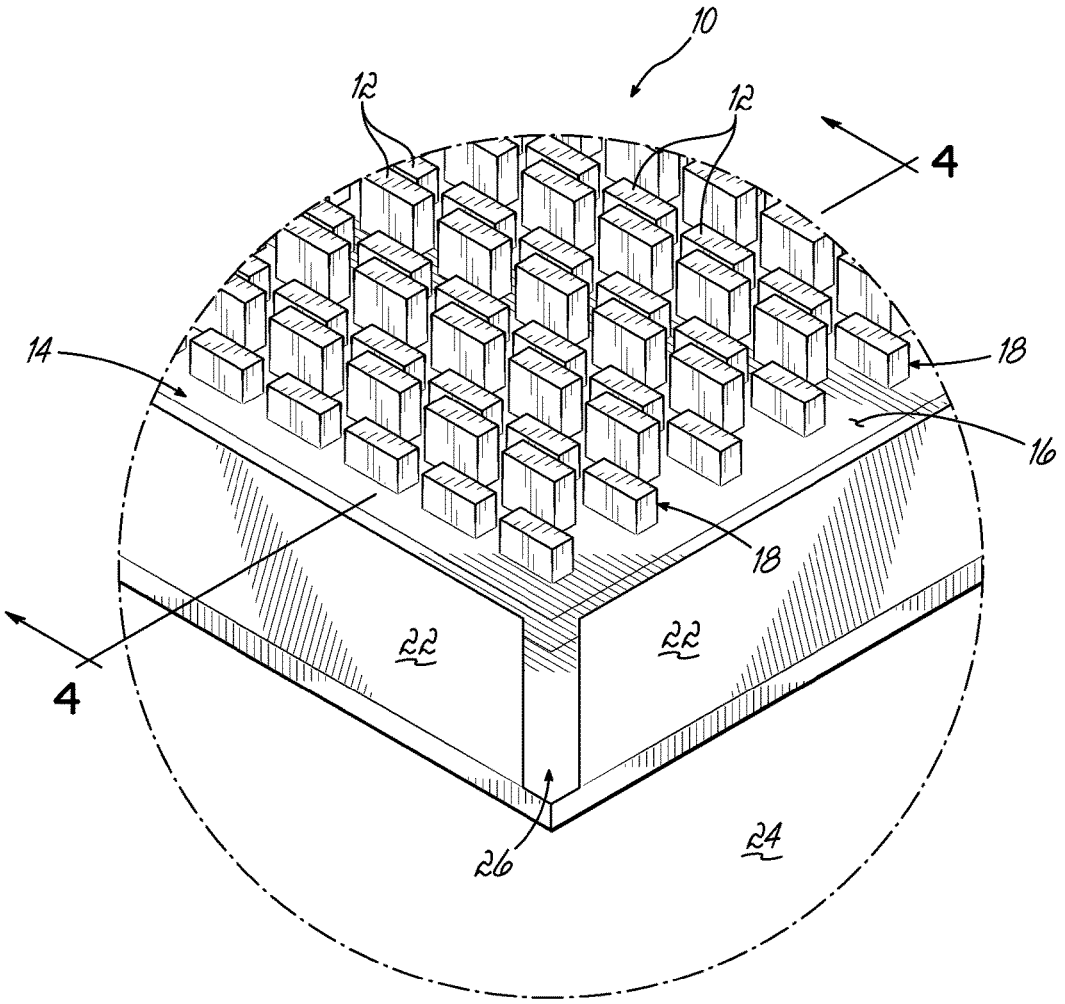
FIG. 2 is an enlarged view of the encircled portion 2 of FIG. 1.

The mat 10 includes a peripheral ramp edge 22 extending around a perimeter of the mat body 14. The ramp edge 22 provides an angled transition from the mat body 14 to a floor 24 upon which the mat 10 is positioned. As such, in various embodiments of this invention, the mat 10 may be considered a scraper mat. A channel 26 is formed at the juncture between two portions of the ramp edge 22, as shown in FIGS. 1 and 2. The channel 26 provides an avenue for the discharge of any accumulated water, fluids, or other materials, from the upper surface 16 of the mat body 14 toward the surrounding floor 24 or other surfaces.

The projections 12 extending upwardly from the mat body 14 may be in any arrangement, configuration, shape, or size, according to this invention. The projections 12 shown in FIGS. 1-4 are each rectangular in cross-sectional configuration and the height of the projections 12 in alternating rows varies, for example. The projections 12 in one row 18 may be less than the height of the projections 12 in an adjacent row 18. For example, as shown in FIG. 4, the height A of the lower projections 12 may be 0.125 inches, and the height B of the taller projections 12 may be 0.1875 inches, according to one embodiment of this invention. Similarly, the width of each projection 12, as indicated by C in FIG. 3, may be 0.09375 inches, and the length of each projection 12, indicated by D in FIG. 3, may be 0.375. The spacing between the adjacent rows 18 of projections 12 is indicated by E in FIG. 3, and may be 0.125 inches in one embodiment of this invention. The projections 12 in each row 18 are spaced longitudinally from one another as indicated by F in FIG. 3 and this dimension may be 0.125 inches in one embodiment.

Figure 3:
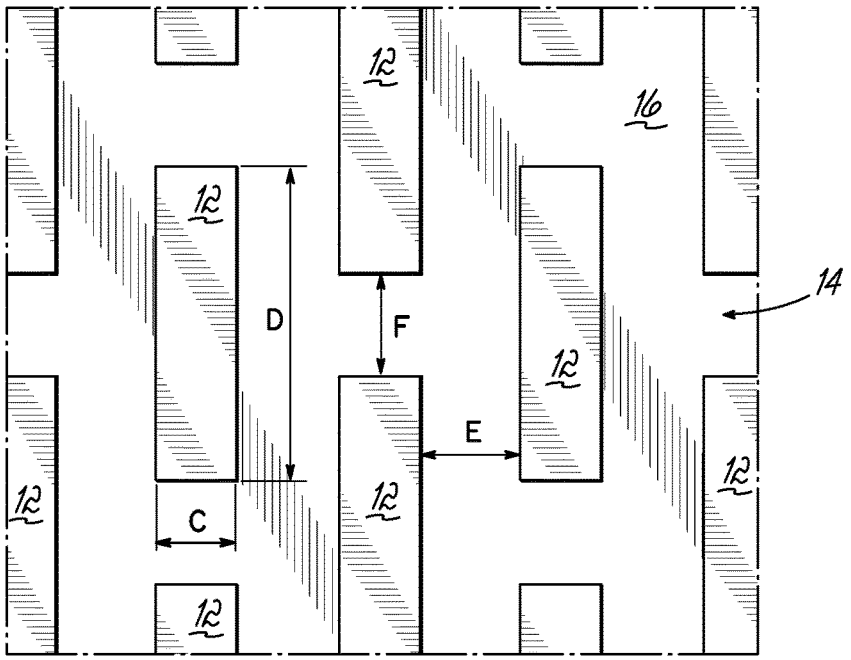
FIG. 3 is a top plan and enlarged view of the mat of FIGS. 1-2.
Figure 4:
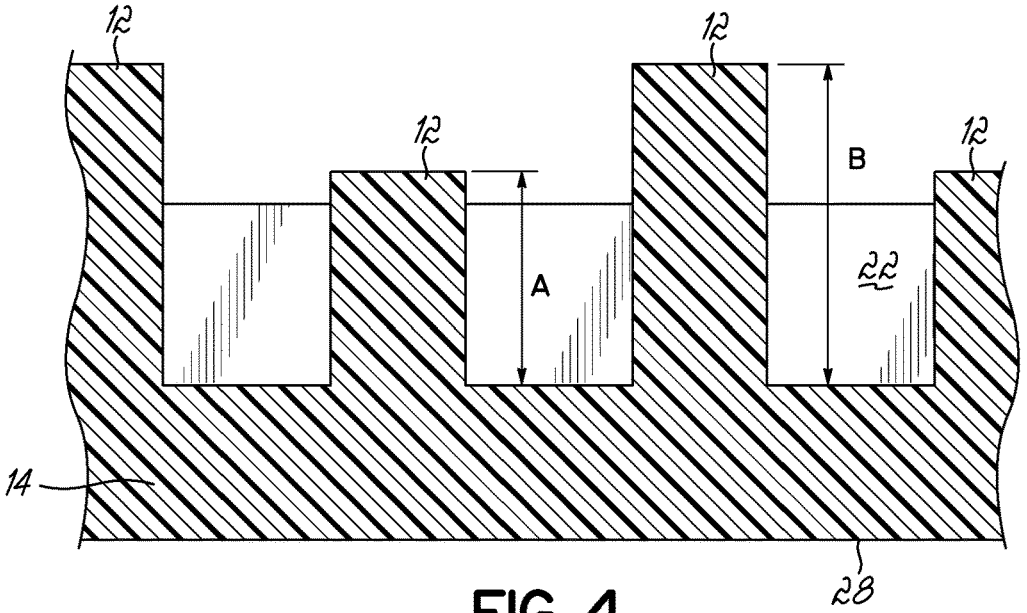
FIG. 4 is a cross-sectional view of the mat of FIG. 2 taken along line 4-4 of FIG. 2.

Additionally, as is readily evident from FIG. 3, the projections 12 in one row 18 are staggered, or offset, from the projections in an adjacent row, such that the gap between the projections in a given row is centered on the projections in each of the adjacent rows.

In various embodiments of this invention, the projections 12 may be considered upstanding teeth or blades; however, the configuration of the projections 12 and their arrangement and spacing may be any of a wide variety of designs within the scope of this invention, with only one such embodiment of this invention being shown and described herein.

In use, when vehicular or foot traffic passes over and atop the mat 10 situated on the floor 24, the projections 12 are able to deflect or bend, relative to the upper surface 16 of the mat body 14. As such, the projections 12 may bend to such a degree as they impact the projections 12 in an adjacent row 18. The interaction of the projections 12 during such loads serves to cushion the user's impact with the mat 10, and likewise, dissipate the lateral and other forces resulting from the interaction with the mat 10 that might otherwise tend to shift, translate, or move the mat 10 relative to the floor 24. It is believed that the ability for the projections 12 to bend relative to a remainder of the mat 10 and the interaction between the bending projections 12 increases the resistance of the mat 10 to slipping relative to the floor 24. Once the load is removed from the mat 10, the projections return to their upright orientation, as shown generally in FIG. 4. A lower surface 28 of the mat 10, as shown in FIG. 4, may have additional friction coating or features to further minimize the slippage of the mat 10 relative to the floor 24. The projections 12 in combination with the exposed upper surface 16 of the mat body 14 contribute to form an upper surface of the mat 10 as shown generally in FIGS. 3-4.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A slip resistant mat comprising:

a mat body having an upper surface and a lower surface for juxtaposing next to a floor surface; and a plurality of projections extending upwardly from the upper surface, the plurality of projections each being capable of deflection from a generally vertical orientation relative to the upper surface of the mat in response to a load applied to the plurality of projections to hereby inhibit movement of the mat relative to the floor surface;

wherein at least some of the plurality of projections contact adjacent projections when deflected;

wherein the plurality of projections are arranged in a plurality of quadrants, with the projections in some of the quadrants being arranged in a perpendicular orientation relative to the projections in other quadrants.

2. The slip resistant mat of claim 1:

wherein a first set of the projections are of one height and a second set of projections are of a second height, different from the first height.

3. The slip resistant mat of claim 1 further comprising:
a peripheral ramp edge extending around a substantial portion of a perimeter of the mat body.

4. The slip resistant mat of claim 1 further comprising:
a channel formed at a perimeter of the mat body to provide for discharge of accumulated fluids from the upper surface of the mat body.

5. The slip resistant mat of claim 1 wherein each of the projections is equally spaced from an adjacent projection.

6. The slip resistant mat of claim 1 wherein a cross-sectional configuration of each of the projections is substantially identical to a cross-sectional configuration of each other projection.

7. A slip resistant mat comprising:
a mat body having an upper surface and a lower surface for juxtaposing next to a floor surface; and
a plurality of projections extending upwardly from the upper surface, the plurality of projections each being capable of deflection from a generally vertical orientation relative to the upper surface of the mat in response to a load applied to the plurality of projections to hereby inhibit movement of the mat relative to the floor surface;
wherein the plurality of projections is arranged in a plurality of generally equally spaced rows and the projections in a first row are staggered relative to the projections in an adjacent row;
wherein the plurality of projections is arranged in a plurality of quadrants, with the projections in some of the quadrants being arranged in a perpendicular orientation relative to the projections in other quadrants;
wherein at least some of the plurality of projections contact adjacent projections when deflected.

8. The slip resistant mat of claim 7 wherein each of the plurality of projections has a generally rectangular cross-section.

9. The slip resistant mat of claim 7 wherein a first set of the projections are of one height and a second set of projections are of a second height, different from the first height.

10. A slip resistant mat comprising:
a mat body having an upper surface and a lower surface for juxtaposing next to a floor surface; and
a plurality of projections extending upwardly from the upper surface, each of the projections is equally spaced from an adjacent projection and is capable of deflection from a generally vertical orientation relative to the upper surface of the mat in response to a load applied to the plurality of projections to hereby inhibit movement of the mat relative to the floor surface;
wherein the plurality of projections is arranged in a plurality of generally equally spaced rows and at least some of the plurality of projections contacts adjacent projections when deflected;
wherein the plurality of projections is arranged in a plurality of quadrants, with the projections in some of the quadrants being arranged in a perpendicular orientation relative to the projections in other quadrants;
wherein the projections in a first row are staggered relative to the projections in an adjacent row.

11. The slip resistant mat of claim 10 wherein each of the plurality of projections has a generally rectangular cross-section.

12. The slip resistant mat of claim 10 wherein a first set of the projections are of one height and a second set of projections are of a second height, different from the first height.

13. A slip resistant mat comprising:
a mat body having an upper surface and a lower surface for juxtaposing next to a floor surface; and
a plurality of projections extending upwardly from the upper surface, each of the projections is equally spaced from an adjacent projection and is capable of deflection from a generally vertical orientation relative to the upper surface of the mat in response to a load applied to the plurality of projections to hereby inhibit movement of the mat relative to the floor surface;
wherein the plurality of projections is arranged in a plurality of generally equally spaced rows and at least some of the plurality of projections contacts adjacent projections when deflected;
wherein the plurality of projections are arranged in a plurality of quadrants, with the projections in some of the quadrants being arranged in a perpendicular orientation relative to the projections in other quadrants.

14. The slip resistant mat of claim 13 further comprising:
a peripheral ramp edge extending around a substantial portion of a perimeter of the mat body.

15. The slip resistant mat of claim 14 further comprising:
a channel formed at a perimeter of the mat body to provide for discharge of accumulated fluids from the upper surface of the mat body.

16. The slip resistant mat of claim 13 wherein a cross-sectional configuration of each of the projections is substantially identical to a cross-sectional configuration of each other projection.

17. A slip resistant mat comprising:
a mat body having an upper surface and a lower surface for juxtaposing next to a floor surface; and
a plurality of projections extending upwardly from the upper surface, each of the projections is equally spaced from an adjacent projection and is capable of deflection from a generally vertical orientation relative to the upper surface of the mat in response to a load applied to the plurality of projections to hereby inhibit movement of the mat relative to the floor surface;
wherein each of the plurality of projections has a generally rectangular cross-section;
wherein the plurality of projections are arranged in a plurality of generally equally spaced rows and at least some of the plurality of projections contact adjacent projections when deflected, wherein the projections in a first row are staggered relative to the projections in an adjacent row;
a first set of the projections are of one height and a second set of projections are of a second height, different from the first height;
wherein the plurality of projections are arranged in a plurality of quadrants, with the projections in some of the quadrants being arranged in a perpendicular orientation relative to the projections in other quadrants;
a peripheral ramp edge extending around a substantial portion of a perimeter of the mat body; and
a channel formed at a perimeter of the mat body to provide for discharge of accumulated fluids from the upper surface of the mat body.

* * * * *